US006092450A

United States Patent [19]

Dueck

[11] Patent Number: 6,092,450

[45] Date of Patent: Jul. 25, 2000

[54] ROTARY CUTTER FOR SHEET MATERIAL

[76] Inventor: Raymond Dueck, Box 700, Arborg, Manitoba, Canada, R0C 0A0

[21] Appl. No.: 09/175,618

[22] Filed: Oct. 20, 1998

Related U.S. Application Data

[63] Continuation-in-part of application No. 08/963,242, Nov. 3, 1997, abandoned, which is a continuation-in-part of application No. 08/825,939, Apr. 1, 1997.

[51] Int. Cl.[7] ..... B26D 7/08

[52] U.S. Cl. ..... 83/174; 83/613; 83/614; 83/487; 83/508

[58] Field of Search ..... 86/613, 614, 174, 86/487, 488, 489, 508, 563

[56] References Cited

U.S. PATENT DOCUMENTS

| | | | |
|---|---|---|---|
| 3,977,286 | 8/1976 | Werner | 83/614 |
| 4,230,029 | 10/1980 | Schott, Jr. | 83/614 |
| 4,383,458 | 5/1983 | Kitai | 83/614 |
| 4,505,174 | 3/1985 | Carithers, Jr. | 83/614 |
| 4,506,575 | 3/1985 | McCay et al. | 83/614 |
| 4,779,500 | 10/1988 | Bennett et al. | 83/614 |
| 4,781,094 | 11/1988 | Moretti | 83/614 |
| 5,090,281 | 2/1992 | Paulson et al. | 83/169 |
| 5,168,786 | 12/1992 | Huggins et al. | 83/614 |
| 5,197,643 | 3/1993 | Augustin | 83/614 |
| 5,421,231 | 6/1995 | Break et al. | 83/614 |
| 5,431,077 | 7/1995 | Murakami | 83/614 |
| 5,775,191 | 7/1998 | Burton et al. | 83/614 |

*Primary Examiner*—M. Rachuba

*Attorney, Agent, or Firm*—Adrian D. Battison; Murray E. Thrift

[57] ABSTRACT

The rotary cutting blade is mounted on a cutting machine which dispenses and cuts sheet material. The cutting machine includes a frame for supporting a cutting table top and a dispenser for supporting a roll of floor covering material. The rotary disk shaped cutting blade is mounted on a support block the frame below the table top for movement along a slot in the cutting table. A cable or chain driven rotary drive drives the block back and forth and at the same time provides the rotary motion to the cutting disk in a direction such that a leading edge of the disk moves upwardly relative to the floor covering material as it cuts. The chain passes over a sprocket on the block which carries a clutch so that the clutch slips when the block reaches one end of the slot and allows the chain to continue driving the rotary blade. A rotary sharpening disk is mounted at one end of the slot and is driven by the chain so as to rotate against the blade in a sharpening action while the block remains stationary.

16 Claims, 10 Drawing Sheets

ROTARY CUTTER FOR SHEET MATERIAL

This application is a continuation-in-part of application Ser. No. 08/963,242 filed Nov. 3rd 1997 abandoned, which is a continuation-in-part of application Ser. No. 08/825,939, filed Apr. 1st 1997.

FIELD OF THE INVENTION

The present invention relates to improvements to cutting apparatus for cutting sheet materials, particularly but not exclusively of the type for use with a rolled supply of floor covering material.

BACKGROUND

Devices used for cutting carpet, vinyl flooring, and other floor covering materials are known. These devices can be as simple as a rack for supporting a roll of floor covering material adjacent a cutting surface such as a floor or table top or may be complex machines. In the simple case where a rack and cutting surface are used the floor covering material is dispensed from the rack onto a cutting surface where it is cut by an individual with a knife. After cutting the floor covering material is manually rerolled. One disadvantage of this method is that large areas are required to lay out the floor covering material during cutting. A second disadvantage is that if the floor covering material is cut on a floor the floor covering material can be damaged by contact with materials on the floor.

More complex apparatus for performing this task are also known. Many include a cradle or rack for supporting the roll of floor covering material to be dispensed, a table top across which the floor covering material is drawn, and a means of automatically rerolling the floor covering material. These components are generally mounted on a frame to keep them raised above the floor at an appropriate height for working. A knife blade arranged for traveling across the table top is usually employed to cut the floor covering material. The knife blade is usually mounted at a fixed angle to the table and moves along a slot running laterally across the table through which the knife blade projects. Various means may be utilized to propelled the knife blade which may include a chain drive mechanism or an air or hydraulic cylinder mechanism. In these devices the cutter is often stopped when it reaches either of the ends of the slot by contacting a stop which prevents further movement along the slot.

Devices of this type using a chain driven mechanism have the problem that they often cut in only one direction, while hydraulic and air driven systems are expensive and costly to maintain. These systems also tend to be excessively noisy. This is caused in part by the impact of the cutter on the stop.

A further problem of existing cutting mechanisms is that the knife blade or blades used are usually mounted at a fixed angle to the table top and as a result tear through the floor covering material as they cut. This can result in a rough edge along the length of the cut instead of a relatively smooth one giving the floor covering material an unfinished look.

SUMMARY

According to the present invention there is provided an apparatus for cutting a length of sheet material from a supply of the sheet material comprising:

a support plate for receiving the floor covering material from the supply having a first side, a second side, a support surface for contacting the sheet, and an inner face opposite the support surface;

a slot in the support plate having a first end adjacent the first side of the support plate and a second end adjacent the second side of the support plate and extending therebetween;

a cutter block mounted adjacent the inner face for movement along the slot between the first and second ends of the slot;

a rotary cutter mounted on the cutter block for rotation about an axis generally parallel to the support wall and generally at right angles to the length of the slot, the rotary cutter having a disk shaped blade with an edge of the disk shaped blade projecting through the slot for cutting the sheet material and a drive shaft mounted on the cutter block for rotation relative thereto about the axis for supporting and driving the disk shaped blade about the axis;

an elongate flexible drive member extending in a direction along the length of the slot;

a first rotatable guide member arranged adjacent the first end of the slot, a second rotatable guide member arranged adjacent the second end of the slot, each of the rotatable guide members having the elongate flexible drive member wrapped there around so that the guide members as they rotate guide movement of the elongate flexible drive member along its length;

the cutter block being connected to the elongate flexible drive member such that movement of the elongate flexible drive member along its length causes movement of the cutter block along the slot;

a rotary drive actuator for driving the elongate flexible drive member along its length in a first direction, thereby causing said movement of the cutter block in a first direction along the slot towards the first end of the slot, and along its length in a second direction thereby causing said movement of the cutter block in a second direction along the slot towards the second end of the slot;

a drive member mounted on the shaft for driving the shaft, the drive member being driven by and receiving motive force from said movement of the cutter block.

BRIEF DESCRIPTION OF THE DRAWINGS

In the accompanying drawings, which illustrate an exemplary embodiment of the present invention.

DETAILED DESCRIPTION

Figure 1:
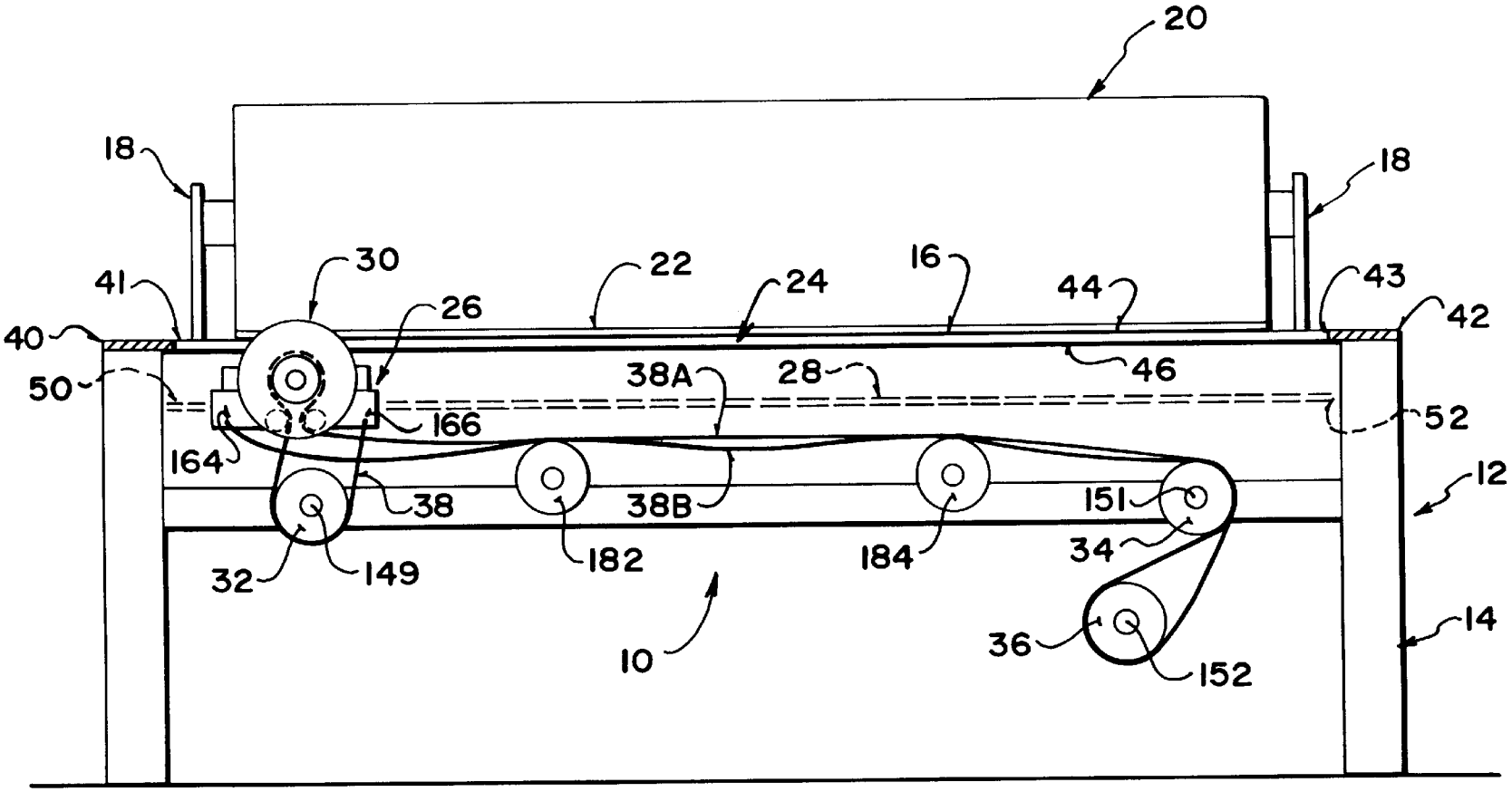
FIG. 1 is a front view of a floor covering material cutting machine mounting the cutter block and rotary cutter.
Figure 2:
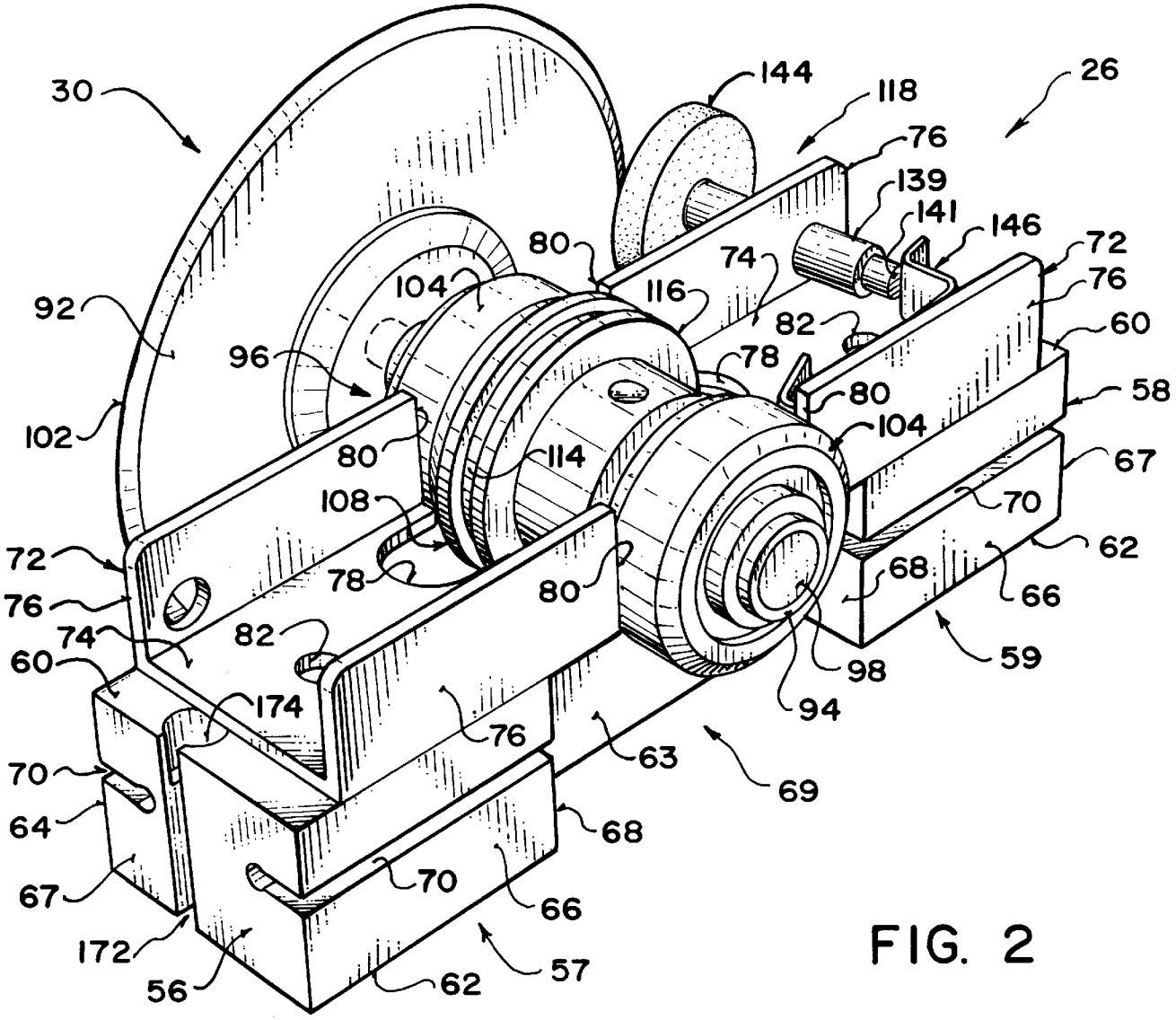
FIG. 2 is an isometric view of the cutter block and rotary cutter.
Figure 3:
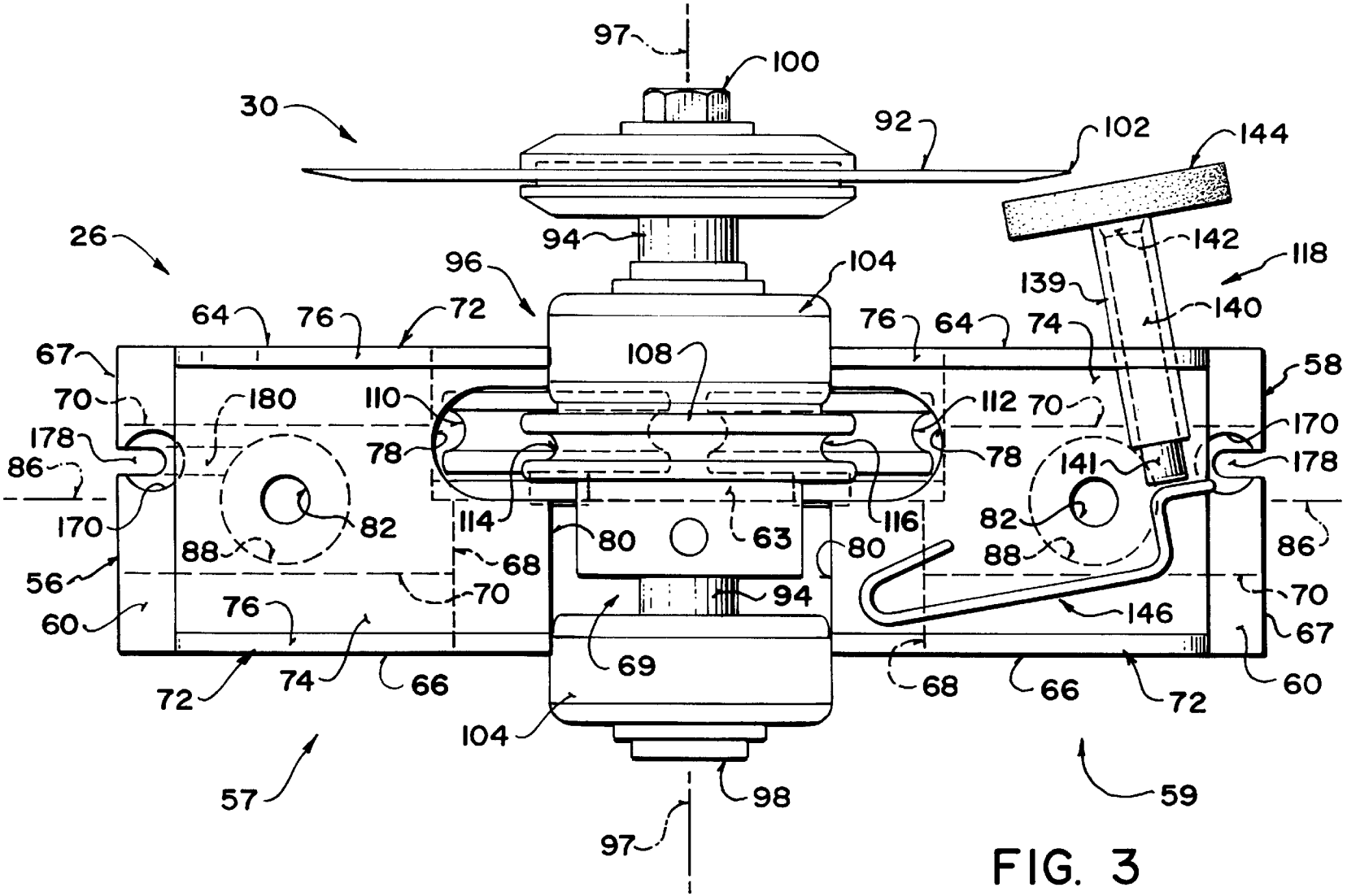
FIG. 3 is a top view of the cutter block and rotary cutter.
Figure 4:
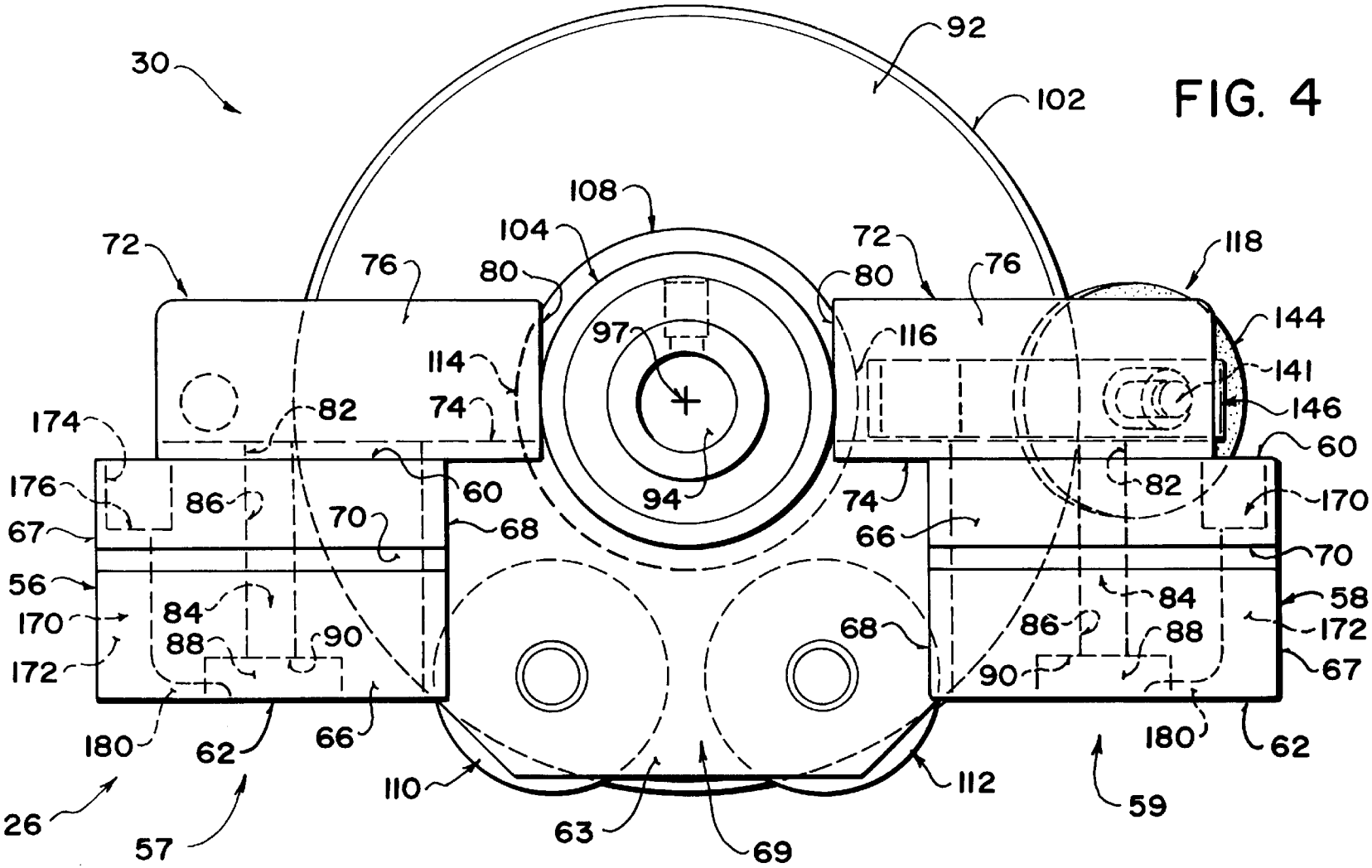
FIG. 4 is a front view of the cutter block and rotary cutter.

Referring to FIG. 1 the cutting mechanism is shown generally at 10. The cutting mechanism 10 is shown mounted on a cutting machine 12 which dispenses and cuts floor covering material. The cutting machine 12 includes a frame 14 for supporting a table top 16 and a dispenser 18 for supporting a roll 20 of floor covering material. The roll 20 is supported such that a portion of the floor covering material 22 can be drawn across the table top 16 for cutting. The cutting mechanism 10 is mounted on the frame 14 below the table top 16 and comprises a cutter block 26, a cutter block guide track 28, a rotary cutter 30 which extends upwards through the table top 16, a first pulley 32, a second pulley 34, drive means 36, and a cable 38.

The table top 16 extends from a first side 40 to a second side 42, and includes an outer face 44 for receiving the floor covering material 22 for cutting, an inner face 46 opposite the outer face 44, and a slot 24 extending laterally across the table top 16.

The slot 24 has a first end 41 adjacent the first side 40 of the table top 16 and a second end 43 adjacent the second side 42 of the table top 16 and extends therebetween. The slot 24 provides an opening for the rotary cutter 30 to extend through and run along while cutting the floor covering material 22. The table top 16 also includes a pair of guide track support members 48 arranged to run across the table top 16 from the first side 40 to the second side 42 (best shown in FIG. 5). The guide track support members 48 are arranged beneath the inner face 46 of the table top 16 and parallel to the slot 24

The cutter block guide track comprises a pair of opposed flanges 28, one arranged along each of the guide support members 48. The opposed flanges 28 are aligned with one another in common plane and extend from the guide support members 48 towards one another. The cutter block guide is spaced downwards from the inner face 46 of the table top 16 and extends parallel to the slot 24. Each flange 28 of the cutter block guide track has a first end 50 arranged adjacent the first end 40 of the table top 16 and a second end 52 arranged adjacent the second end 42 of the table top 16.

Referring to FIGS. 2 to 5 the cutter block 26 extends from a first end 56 to a second end 58. The first end 56 is arranged to face the first side 40 of the table top 16 and the second end 58 is arranged to face the second side 42 of the table top 16. The cutter block 26 comprises a first block member 57, a second block member 59, a pair of U-shaped plates 72, and a connecting plate 63.

Each of the first and second block members 57 and 59 have a top face 60, a bottom face 62, a first side 64, a second side 66, a first end 67 and a second end 68. The block members 57 and 59 are spaced apart from one another leaving a gap 69 therebetween and are aligned with one another such that the first end 67 of the second block member 59 lies adjacent the second end 68 of the first block member 57. The first end 67 of the first block member 57 is the first end 56 of the cutting block 26 and the second end 68 of the second block member 59 is the second end 58 of the cutting block 26.

The cutter block 26 is arranged between the guide support members 48 of the table top 16 adjacent the inner face 46 of the table top 16 for movement along the slot 24 between the first and second ends 41 and 43 of the slot 24. The first and second sides 64 and 66 are opposed to each other and lie adjacent respective guide support members 48 of the table top 16. Each side 64 and 66 of first and second block members 57 and 59 includes a horizontal groove 70 extending longitudinally along the respective block member 57 or 59 from the first end 67 to the second end 68 of the block members 57 or 59. The grooves 70 on corresponding sides 64 or 66 of the block members 57 and 59 align longitudinally with one another and are arranged to slidably receive a respective one of the flanges 28 such that the cutter block 26 is arranged on the cutter block guide for movement along the length of the slot 24.

Each of the pair of U-shaped plates 72 is arranged to lie along the top face 60 of the cutting block 26 between the cutting block 26 and the inner face 46 of the table top 16. Each U-shaped plate 72 has a base web 74, side flanges 76 extending along opposing sides of the base web 74 and upwards therefrom, and a notch 78 lying between the side flanges 76 at one end 80 of the base web 74. Each of the U-shaped plates 72 is fixed to the top face 60 of a respective one of the first and second block members 57 and 59 such that the side flanges 76 extend upwards from the block members 57 and 59 and the notches 78 face one another across the gap 69. The side flanges 76 extend along the length of each block member 57 and 59 and provide a mounting point for a sharpening disk 144 described in more detail hereinafter. The end 80 of each U-shaped plate 72 is fixed to the shaft mount 96 of the rotary cutter 30 thereby securing the rotary cutter 30 to the cutting block 26.

Each of the U-shaped plates 72 includes a hole 82 extending through the base web 74. The hole 82 through the U-shaped plate 72 is arranged to align with a first hole 84 through each of the first and second block members 57 and 59.

The first hole 84 extends through each of the first and second block members 57 and 59 from the top face 60 to the bottom face 62, and is aligned to receive a fastener, for example a bolt, therethrough. The first hole 84 includes a narrow portion 86 adjacent the top face 60 of the respective block member 57 or 59 for receiving a shaft of the fastener, a wider portion 88 adjacent the bottom face 62 of the respective block member 57 or 59 for receiving a retainer of the fastener, and a shoulder 90 at a transition from the narrow portion 86 to the wider portion 88. The shoulder 90 prevents the fastener from moving along the length of the hole 84 thereby securing the fastener within the hole 84 and the block member 57 or 59 on the U-shaped plate 72.

Referring to FIGS. 1 and 6 the drive means 36 comprise a first pulley 32, a second pulley 34, the cable 38, and a driven rotatable drum 152 which drives the cable 38 over the pulleys 32 and 34 moving the cutting block 26 along the length of the slot 24 and drawing the cable through the rotary cutter 30. The drive means 36 selectively move the cable 38 in one of a first direction causing movement the cutter block 26 along the slot 24 towards the first end 41 of the slot 24 and driving the rotary cutter 30 in a first rotary direction, and a second direction causing movement of the cutter block 38 along the slot 24 towards the second end 43 of the slot 24 and driving the rotary cutter 30 in a second rotary direction.

The first and second pulleys 32 and 34 are arranged adjacent respective sides 40 and 42 of the table top 16 and are arranged below the table top 16 and the cutting block 26. The first pulley 32 is arranged to lie near the first side 40 of the table top 16 at a position spaced from the first side 40 of the table top 16 in a direction towards the second side 42 of the table top 16. The first pulley is also spaced downwards from the inner face 46 of the table top 16 and from the cutter block 26.

The second pulley 34 is a double pulley defined by two separate pulley elements which are independently rotatable and arranged to lie near the second end 42 of the table top 16 at a position spaced from the second end 42 of the table top 16 in the direction towards the first end 40 of the table top 16 and spaced downwards from the inner face 46 of the table top 16 and from the cutter block 26.

The cable 38 extends over the pulleys 32 and 34 and is connected to the cutting block 26. The cable 38 is arranged to extend around each of the first and second pulleys 32 and 34. A first portion of the cable 38 extends over and around the first element of the second pulley 34 and then connects at a first end 164 of the cable 38 to the first end 56 of the cutter block 26. A second portion of the cable 38 extends over and around the second element of the second pulley 34 over and around the pulley 32 to the second end 166 of the cable 38 at the second end 58 of the cutter block 26.

Figure 5:
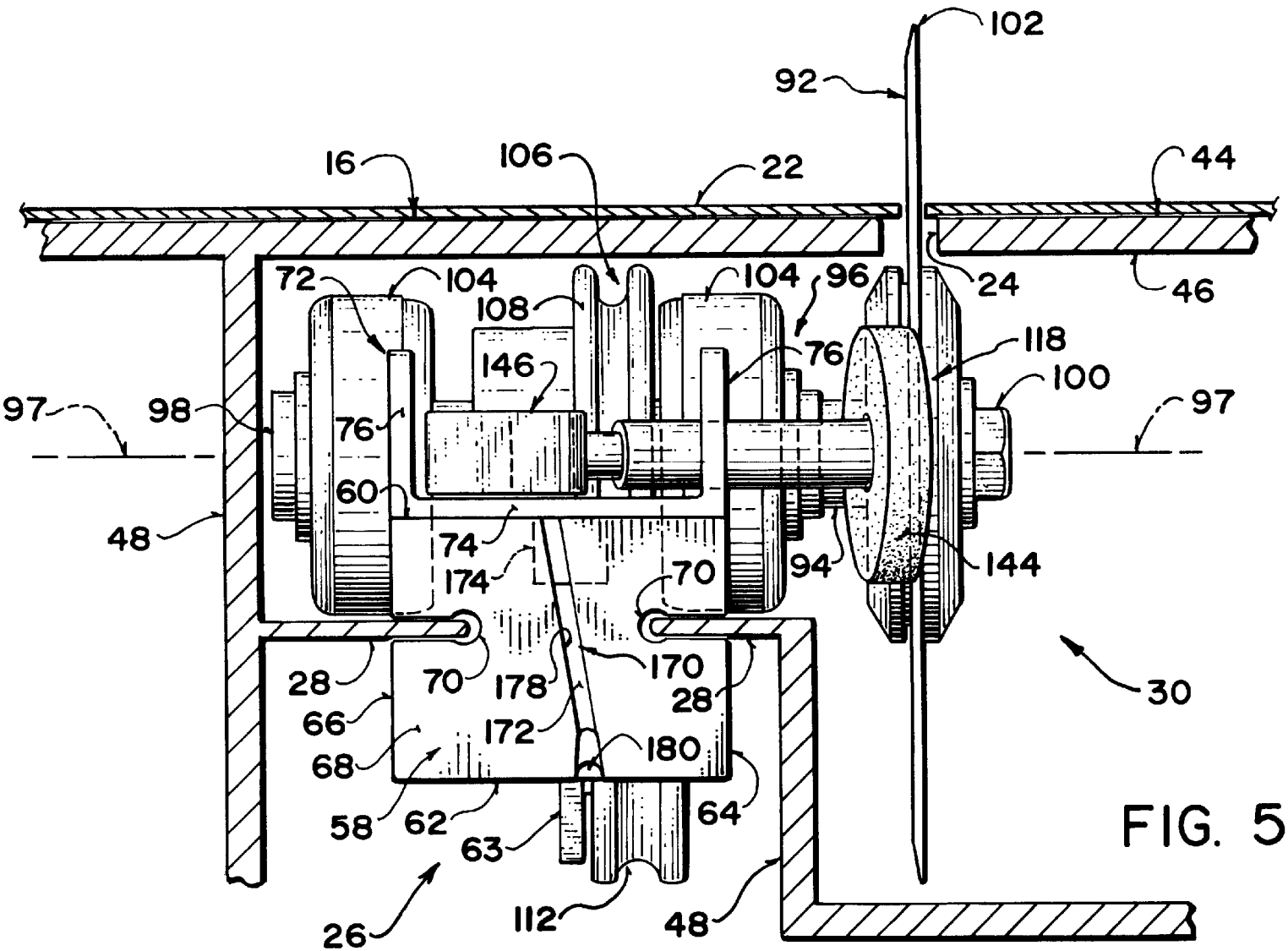
FIG. 5 is a side view of the cutter block and rotary cutter.

Referring to FIG. 5 the first and second ends 164 and 166 of the cable 38 are fixed to the cutting block 26 at the first and second ends 56 and 58 of the cutting block 26. Each end 56 and 58 includes a second hole 170 extending through the corresponding first or second block member 57 or 59 from the top face 60 of the cutting block 26 to the bottom face 62. Each second hole 170 is arranged to receive a corresponding one of the first or second ends 164 or 166 of the cable 38. The second hole 170 in the first block 57 is arranged adjacent the first end 56, and the second hole 170 in the second block 59 is arranged adjacent the second end 58.

The second hole 170 includes a narrow portion 172 adjacent the bottom face 62 of the respective block member 57 or 59 for receiving an end 164 or 166 of the cable 38, a wider portion 174 adjacent the top face 60 of the respective block member 57 or 59 for receiving a retainer for the cable 38, and a shoulder 176 at a transition from the narrow portion 172 to the wider portion 174 The shoulder 176 prevents the retainer from moving along the length of the hole 170 and secures the cable 38 and retainer in place within the hole 170.

A channel 178 extends along the corresponding ends 56 and 58 of the block 57 or 59 This channel 178 extends from each respective end 56 and 58 to the hole 170. The channel 178 allows a corresponding one of the ends first or second ends 164 or 166 of the cable 38 to be inserted in the slot. A retainer is connected to each end 164 and 166 of the cable 38 and is arranged within the wider portion 174 of the hole 170.

A cable alignment notch 180 is arranged on each end of 56 and 58 are the cutting block 26. The cable alignment notches 180 are arranged at the bottom 62 of each respective side 56 and 58.

The cable 38 and first and second pulleys 32 and 34 are arranged such that the cutter block 26 can travel along the slot 24 towards the first end 41 of the slot 24 until the first end 56 of the cutting block 26 passes a center 149 of the first pulley 32. As the first end 56 of cutter block 26 passes the center 149 of the first pulley 32 the first and second ends 164 and 166 of the cable 38 are drawn taut stopping further movement of the cutter block 26 towards the first end 41 of the slot 24. Movement of the cutter block 26 along the slot 24 towards the second end 43 of the slot 24 is stopped in a similar manner when the cutter block 26 reaches a position where the second end 58 of the cutter block 26 passes a center 151 of the second pulley 34. Stopping the movement of the cutter block in this way eliminates the need for a stop and therefore eliminates any noise that would be caused by collisions between the cutter block and the stop.

The driven rotatable drum 152 drives the cable 38 over the pulleys 32 and 34. The cable 38 is wound around the drum 152 such that rotating the drum 152 in a first rotational direction reels in the first end 164 of the cable 38 toward the pulley 34 and pays out the second end 166 of the cable 38 thereby drawing the cutter block 26 in the first direction D1. Rotating the drum 152 in a second rotational direction reels in the second end 166 of the cable 38 toward the pulley 32 and pays out in the first end 164 of the cutter block 26 thereby drawing the cable 38 in the second direction D2.

Rotating the drum 152 in the first direction therefor draws the first end 164 of the cable 38 taut thereby moving the cutter block 26 along the slot 24 towards the first end 41 of the slot 24.

Rotating the drum 152 in the second direction therefore draws the second end 166 of the cable 38 taut thereby moving the cutter block 26 along the slot 24 towards the second end 43 of the slot 24.

The drive means also include a first idler pulley 182 arranged to lie at a position adjacent the first pulley 32 and between the first and second pulleys 32 and 34 and a second idler pulley 184 arranged to lie at a position adjacent the second pulley 34 and between the first and second pulleys 32 and 34. The cable 38 is arranged to extend over the first and second idler pulleys 182 and 184 so as to be guided and supported thereby.

The rotary cutter 30 is mounted on the cutting block 26 with the blade 92 of the rotary cutter 30 extending upwards from the cutting block 26 through the slot 24.

The rotary cutter 30 comprises a shaft 94 having an axis of rotation 97 substantially perpendicular to the slot 24, a shaft mount 96 for rotatably mounting the shaft 94 on the cutter block 24, and a rotary cutting blade 92 mounted on the shaft 94 for rotation therewith.

The shaft 94 extends laterally across the cutter block 24 and substantially perpendicular to the slot 24 and is mounted to be selectively rotatable about the axis of rotation 97 in one of first and second rotary directions. The shaft 94 has a first end 98 and a second end 100 and extends from the first end 98 across the block 22 and past the first side 64 of the cutter block 24 to the second end 100. The second end 100 lies adjacent and below the slot 24 and the inner face 46 of the table top 16 and projects across the slot 24.

The rotary cutting blade 92 is fixed to the shaft 94 adjacent the second end 100 of the shaft 94 for rotation with the shaft 94. The rotary cutting blade 92 lies substantially parallel to the slot 24 and extends from below the inner face 46 of the table top 16 through the slot 24 to above the outer face 44 of the table top 16. The rotary cutting blade 92 is a circular cutting disk having a cutting edge 102 arranged around its circumference.

The shaft mount 96 comprises a pair of spaced apart bearings 104 fixed to the ends 80 of the U-shaped plates 72 and arranged such that each bearing 104 lies adjacent a respective side 64 and 66 of the cutter block 24. The bearings 104 are aligned with one another and arranged to receive the shaft 94 therebetween such that they allow rotation of the shaft 94 in either of the first or second rotary directions.

Figure 6A:
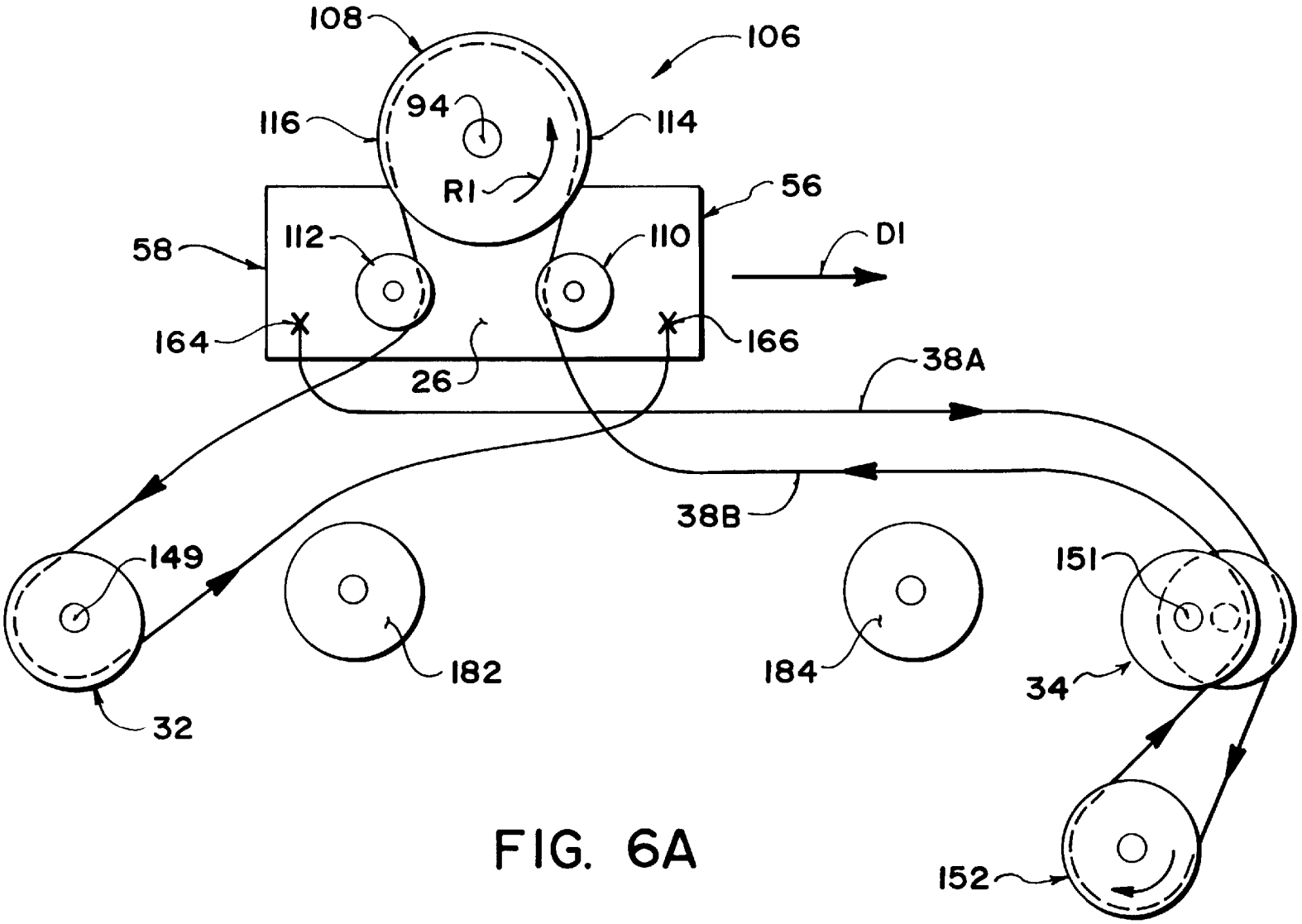
FIGS. 6A and 6B are schematic illustrations showing the movement of the cutter block along the slot and the action of the cable drive.
Figure 6B:
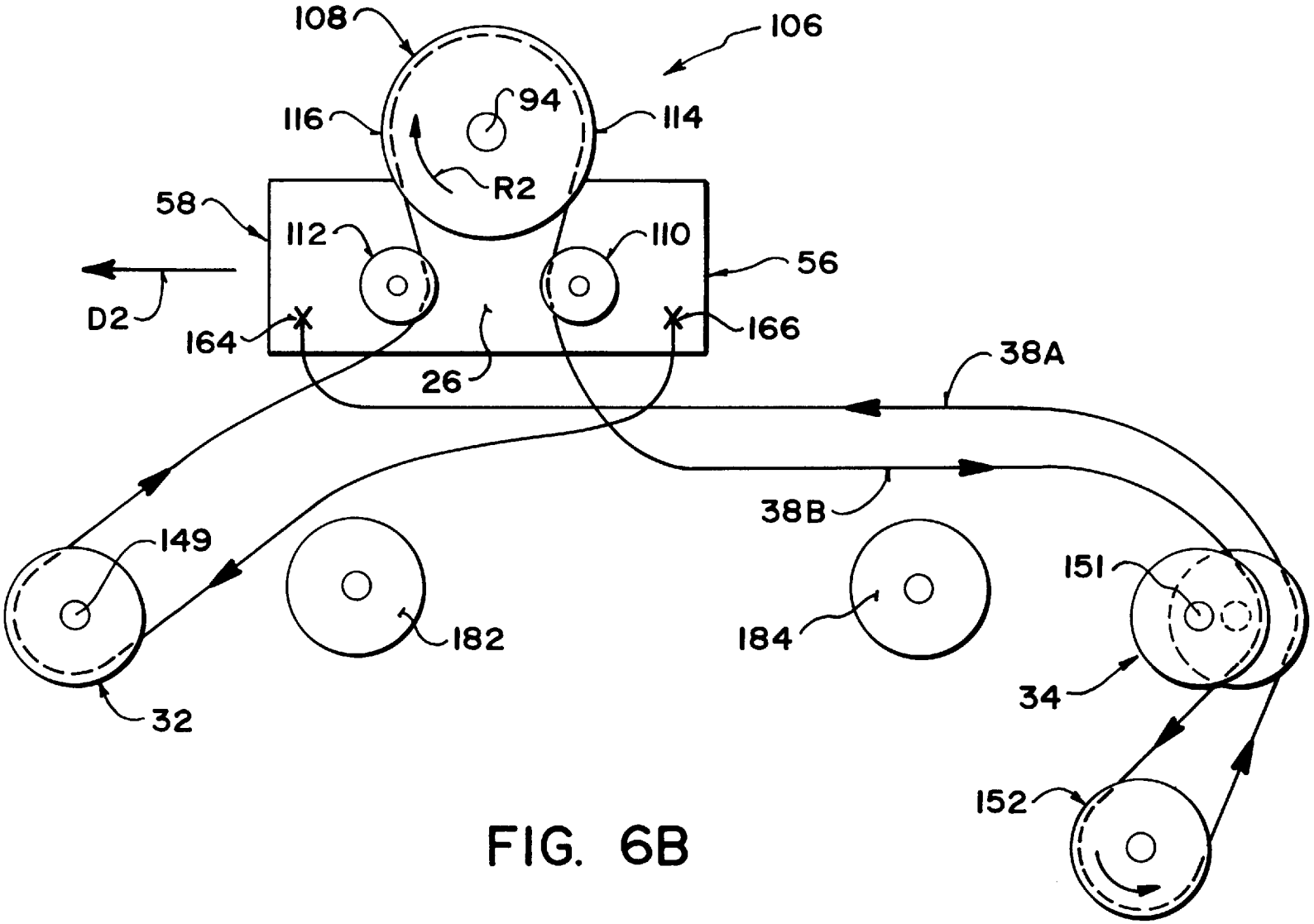
Figure 7:
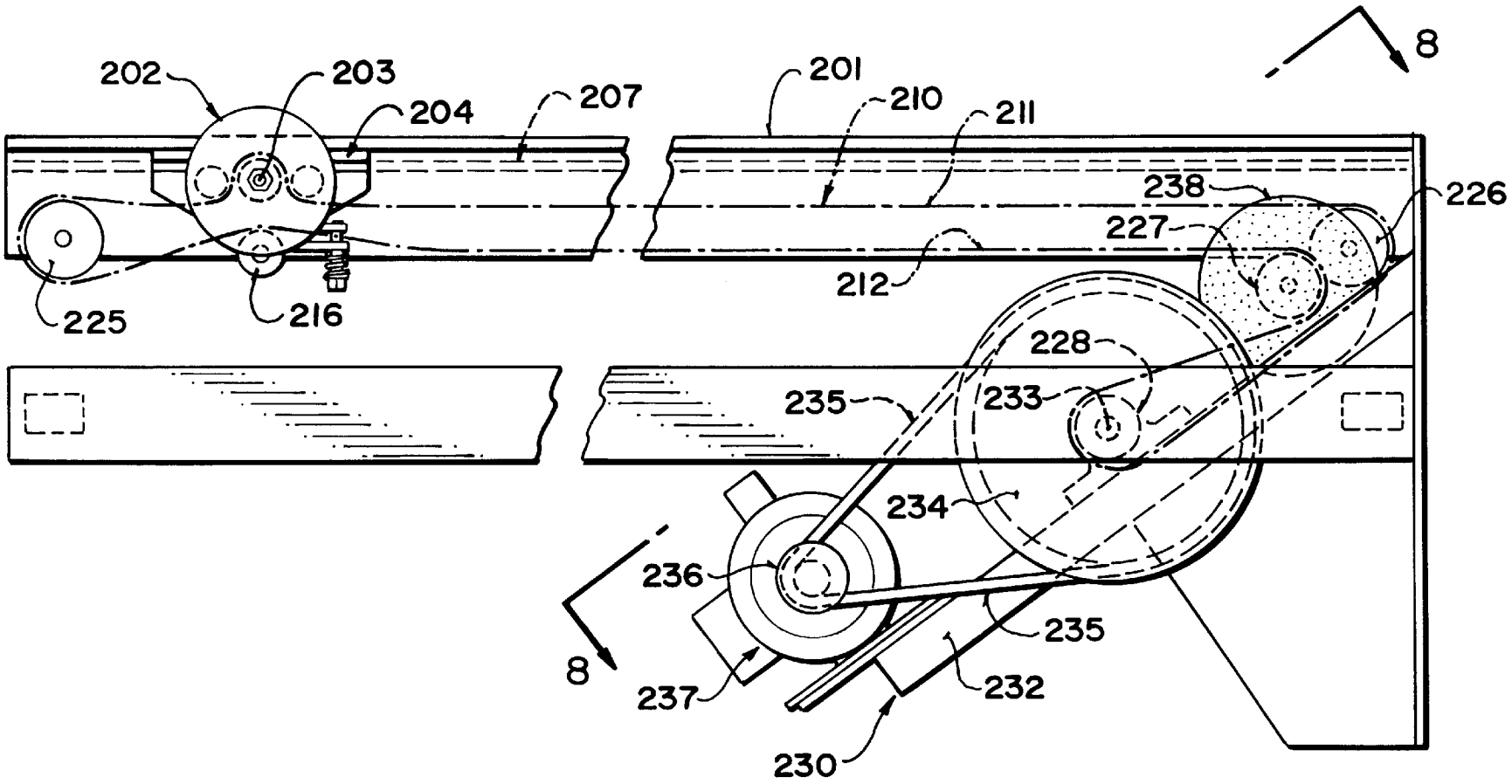
FIG. 7 is a front elevational view of a second embodiment of a rotary cutter according to the present invention.
Figure 8:
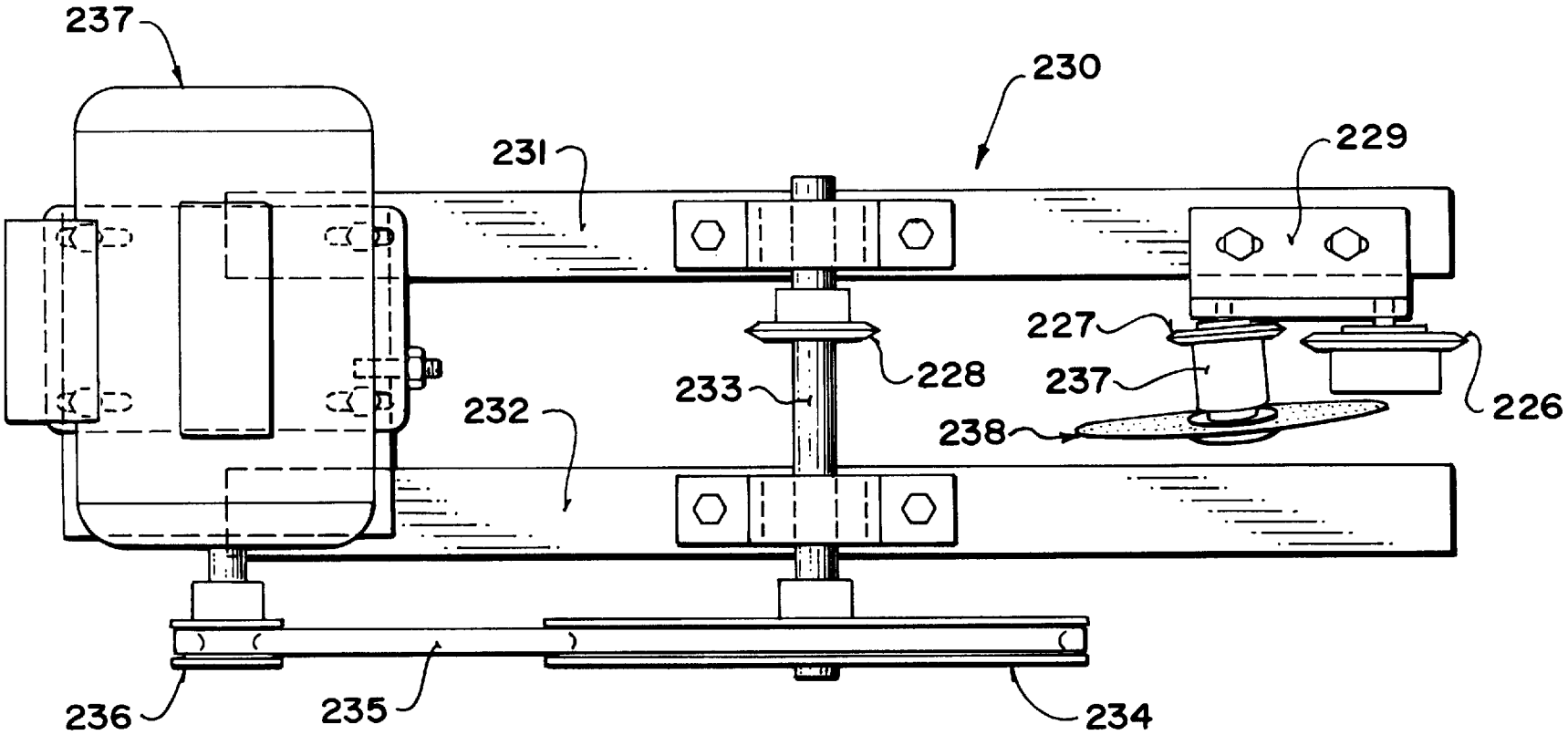
FIG. 8 is a plan view along the lines 8—8 of FIG. 7.
Figure 10:
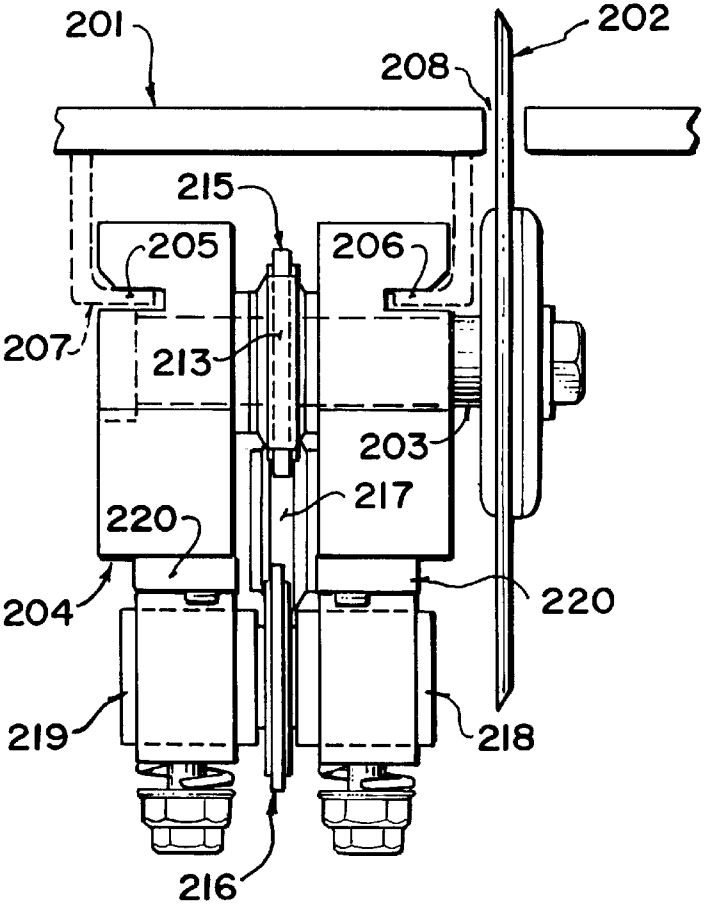
FIG. 10 is a side elevational view the cutter block of FIG. 9.
Figure 9:
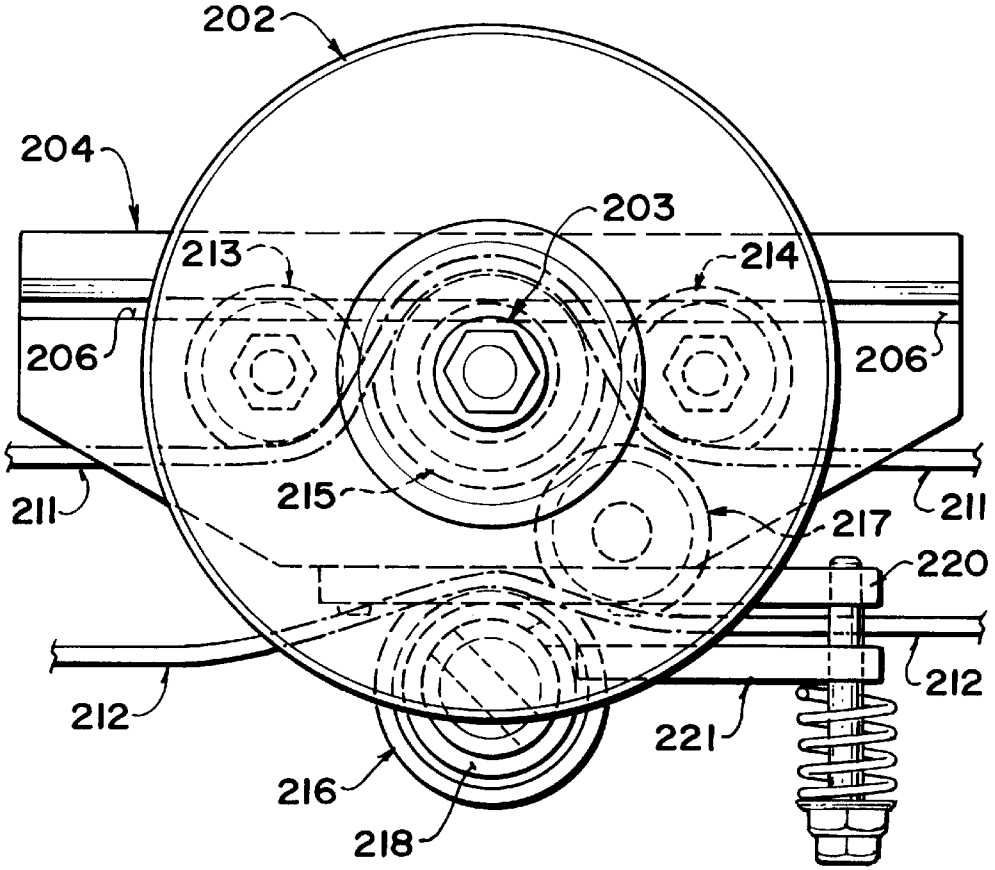
FIG. 9 is a front elevational view of the cutter block only of FIG. 7 on an enlarged scale.

As shown best in FIGS. 6A and 6B, the rotary cutter 30 includes rotary drive means 106 cooperating with one run of the cable 38 which selectively drive the rotary cutting blade 92 in one of the first or second rotary directions R1 and R2. The rotary drive means comprise a drive pulley 108, and first and second guide pulleys 110 and 112. The drive pulley 108 is mounted on the shaft 94 fixed perpendicular to the shaft 94 at a location lying in the gap 69 (FIG. 2) between the block members 57 and 59 and between the sides 64 and 66 of the cutter block 24. The drive pulley 108 lies in line with and extends into the notch 78 in each of the U-shaped plates 72. The drive pulley 108 has a first side 114 facing the first end 56 of the cutter block 24 and a second side 116 facing the second end 58 of the cutter block 24.

The first and second guide pulleys 110 and 112 are spaced apart from one another and arranged within the gap 69 perpendicular to the shaft 94. The guide pulleys 110 and 112 lie below the drive pulley 108 with one to each side 114 and 116 of the drive pulley 108. The first guide pulley 110 lies beneath and adjacent the first side 114 of the drive pulley 108 and the second guide pulley 112 lies beneath and adjacent the second side 116 the drive pulley 108.

The second run of the cable 38 which passes to the pulley 32, extends under and around the first guide pulley 110 then over the drive pulley 108 from the first side 114 of the drive pulley 108 to the second side 116 of the drive pulley 108 and under and around the second guide pulley 112.

As shown in FIG. 6A, as the cutter block 26 and the first run 38A of the cable move in the first direction D1, the second run of the cable moves in the opposite direction and causes the drive pulley 108 to rotate the cutter blade 92 in the first rotary direction R1 such that the cutting edge 102 of the rotary cutting blade 92 moves upwards relative to the first end 56 of the cutting block 26 thereby cutting the floor covering material 22 with an upwards cutting motion as the cutting block 26 moves along the slot 24 towards the first end 41 of the slot 24.

As shown in FIG. 6B, as the cutter block and the first run 38A of the cable move in the second direction D2, the second run 38B of the cable moves in the opposite direction and causes the drive pulley 108 to rotate the cutter blade 92 in the second rotary direction R2 such that the cutting edge 102 of the rotary cutting blade 92 moves upwards relative to the second end 58 of the cutting block 24 thereby cutting the floor covering material 22 with an upwards cutting motion as the cutting block 26 moves along the slot 24 towards the second end 43 of the slot 24.

The cutter block 26 includes a cutter blade sharpener 118 mounted on the cutter block 26 for continuous sharpening of the cutting blade 92. The cutter blade sharpener 118 comprise a shaft 140 slidably mounted on the cutter block 26 by engagement within a hollow tube 139 fixed to the cutter block 26. The shaft 140 has a first end 141 and a second end 142 and extends laterally outwards at a slight angle to the cutter block 26 to the second end 142. The second end 142 is arranged to lie adjacent the cutting blade 92.

A sharpening disk 144 is fixed to the second end 142 of the shaft 140 perpendicular to the shaft 140 for cooperation with the cutting edge 102 of the cutting blade 92. The first end 141 of the shaft 140 extends from the hollow tube 139 and is engaged by a spring 146 fixed to the U-shaped top plate 72 on the top 60 of the block member 59. The spring 146 biases the shaft 140 towards the cutting blade 92 and biases the sharpening disk 144 into contact with the cutting blade 92. As the cutting blade 92 rotates, contact between the sharpening disk 144 and the cutting edge 102 sharpens the cutting blade 92.

In use floor covering material 22 is rolled out over the table top 16 and across the cutting mechanism. The drive means 36 are actuated rotating the rotatable drum 152 in the first direction and causing the first end 164 of the cable 38 to be drawn towards the first side 40 of the table top 16. Since the first end 164 of the cable 38 is fixed to the second end 58 of the cutting block 26 this draws the second end 58 and thereby the entire cutter block 26 towards the first side 40 of the table top 16. As the cutting block 26 is drawn along the slot 24 in the first direction D1 the cutting blade 92 of the rotary cutter 30 is rotated in the first rotary direction R1 moving the blade 92 with an upwards motion relative to the first end 56 of the cutter block and the floor covering material 22 as it cuts. The upwards cutting motion cuts the floor covering material 22 from below with a slicing action which reduces the amount of tearing and fraying of the floor covering material 22. As the cutting block 26 nears the first side 40 of the table top 16 the first end 56 of the cutting block 26 passes the center 149 of the first pulley 32 drawing the first and second ends 164 and 166 of the cable 38 taut. This stops the cutter block 26 and leaves cutter block 26 in a position to begin cutting in the opposite direction. More floor covering material 22 may now be dispensed across the table 16 and the cutting mechanism 10 may be operated in the opposite direction by actuating the drive means 36 such that the rotatable drum 152 is rotated in the second direction. This causes the cutting block 26 to move along the slot 24 from the first end 43 towards the second end 41 in a similar manner to that described above.

Turning now to FIGS. 7 through 10 there is shown an alternative arrangement utilizing many of the principles and constructions described hereinbefore. Thus there is a table surface 201 over which the sheet material can be passed, the table surface having a slot through which a disc shaped blade 202 extends substantially as previously described. The disc blade is mounted on a shaft 203 carried in bearings on a mounting block 204. The mounting block has slots 205 and 206 running in mounting flanges 207. Thus the block can slide back and forth along the length of the slot 208 while the disc 201 projects through the slot and rotates about the axis of the shaft.

A drive chain 210 includes an upper run 211 and a lower run 212. The upper run 211 passes underneath a pair of idler sprockets 213 and 214 each on a respective side of the shaft 203. Between the idler sprockets 213 and 214 is mounted a drive sprocket 215 which is carried on the shaft so that the upper run 211 of the chain passes underneath the idler sprocket and over the top of the drive sprocket 215 thus providing drive rotation of the shaft and the disc blade carried thereby.

The lower run 212 passes over a sprocket 216 and is held in contact with the sprocket 216 by an idler 217. The sprocket 216 is carried on a shaft with a pair of friction members 218 and 219 so that rotation of the sprocket drives the friction members. The sprocket and friction members are mounted upon a spring mounted support bar 219 and the friction members are pressed against rub plates 220 carried on the block.

When the friction members 218 and 219 are pressed against the rub plates, the sprocket 216 is held against rotation so that the lower run 212 of the chain is fixed to the block and acts to move the block as the chain moves. In the event that the block is halted at one end of the slot, further movement of the chain causes slippage of the friction members against the rub plates allowing the sprocket to rotate with the chain while the block remains stationary. If a downward force is applied to the sprocket 216 by the chain, this tends to pull the sprocket on the spring mount 221 downwardly thus pulling the friction members away from the rub plates and reducing the amount of force necessary to cause slippage.

At one end of the slot is provided a first idler sprocket 225 with the chain 210 wrapped around the idler sprocket to define the upper run 211 passing over the top and the lower run 212 passing under the bottom.

At the opposite end of the slot is provided two sprockets 226 and 227 with the upper run of the chain passing over the top of the upper sprocket 226 and the lower run of the chain passing over the lower sprocket 227. From those sprockets the chain lengths pass over a drive sprocket 228 which is located inwardly and downwardly from the two end sprockets 226, 227. Thus the upper run of the chain passes around the upper outer sprocket 226 and downwardly and inwardly around the under side of the sprocket 228. The lower run of the chain passes from the upper part of the drive sprocket 228 around the sprocket 227. Sprockets 226 and 227 are mounted on separate shafts with the shafts carried on a common support bracket 229. The support bracket 229 is carried on a support frame 230 having two side rails 231 and 232. The sprocket 228 is mounted on a shaft 233 carried in bearings on each of the rails 231 and 232 so that a forward end of the shaft 233 projects beyond the rail 232 and carries a drive pulley 234. The drive pulley via a belt 235 from the pulley 236 of a main drive motor 237. The motor 237 is carried on the frame 230.

The motor when driven in one direction moves the block toward the right as shown so as to move toward the sprocket 226 and 227. This direction of movement moves the lower run of the chain toward the right and the upper run of the chain toward the left so that the blade disc is driven in a counterclockwise direction with a leading edge thus moving upwards. When the block reaches the right hand end of the slot, the lower run of the chain is pulled downward from the top of the sprocket 216 thus tending to pull the sprocket 216 downwardly and release the clutch. The block is prevented from further movement in the direction toward the right by the fact that the chain becomes tensioned and halts movement of the sprocket 216 in the direction toward the right. The clutch is therefore slip so that the block is stationary while the chain continues to run. The running chain therefore drives the blade disc while the block is held stationary.

The sprocket 227 is mounted on a shaft 237 which carries at its opposite end a grinding disc 238. The grinding disc is arranged so that it has a plane at an angle to the plane of the disc blade with the angle being set at a required angle to effect a sharpening action of the edge of the disc blade. Thus the position of the sharpening disc is arranged relative to the location where the block stops so that the edge of the disc blade is pressed against the face of the sharpening disc to effect a sharpening action as both the disc blade and the sharpening disc are driven by the chain.

The operator will therefore in practice maintain operation of the motor 237 after the block reaches the right hand end so as to effect a sharpening action of the disc blade. When the sharpening action is complete, the motor is halted so that the disc blade is held at the right hand end awaiting a further cutting action. When a further cutting action is required, the motor 237 is driven in the opposite direction so that the block moves toward the left that is toward the sprocket 225 carried in a direction by movement of the lower run 212. Meanwhile the upper run 211 moves toward the right thus driving the disc blade in a clockwise direction. At the left hand adjacent the sprocket 225, the same action occurs as at the right hand end in that the position of the bottom edge of the sprocket 225 below the top of the sprocket 216 pulls the lower run of the chain downwardly as the sprocket 216 approaches the sprocket 225. The tension in the chain is sufficient to prevent the sprocket 216 reaching the sprocket 225 so that at that position when the tension reaches a predetermined level, the block stops while the sprocket 216 is pulled downwardly thus releasing the clutch and allowing the lower run of the chain to slip relative to the block and to continue running. In this way the control of the position of the block is effected automatically without the necessity for limit switches or physical stops which would impact the block with excessive jarring action. The block is automatically stopped by the tensioning of the chain of the chain and the motor can continue to run without damage to the system.

In addition the continued movement of the chain is used to effect a sharpening action in which both the sharpening disc and the disc blade are rotated so that an effective sharpening action occurs around the full periphery of the disc blade and over the area of the sharpening disc thus maximizing the use of the sharpening disc and reducing the requirement for replacement.

While embodiments of the present invention has been described in the foregoing, it is to be understood that other embodiments are possible within the scope of the invention. The invention is to be considered limited solely by the scope of the appended claims.

What is claimed is:

1. Apparatus for cutting a length of sheet material from a supply of the sheet material comprising:

a support member for receiving the sheet material from the supply having a first side, a second side, a support surface for contacting the sheet material, and an inner face opposite the support surface;

the support member defining a slot having a first end adjacent the first side of the support member and a second end adjacent the second side of the support member and extending therebetween;

a cutter block mounted adjacent the inner face for movement along the slot between the first and second ends of the slot;

a rotary cutter mounted on the cutter block for rotation about an axis generally parallel to the support surface and generally at right angles to the length of the slot, the rotary cutter having a disk shaped blade with an edge of the disk shaped blade projecting through the slot for cutting the sheet material and a drive shaft mounted on the cutter block for rotation relative thereto about the axis for supporting and driving the disk shaped blade about the axis;

an elongate flexible drive member extending in a direction along the length of the slot;

a first rotatable guide member arranged adjacent the first end of the slot, a second rotatable guide member arranged adjacent the second end of the slot, each of the rotatable guide members having the elongate flexible drive member wrapped there around so that the guide members as they rotate guide movement of the elongate flexible drive member along its length;

a rotary drive actuator for driving the elongate flexible drive member along its length in a first direction, thereby causing said movement of the cutter block in a first direction along the slot to a first endmost position of the cutter block adjacent the first end of the slot, and along its length in a second direction thereby causing said movement of the cutter block in a second direction along the slot to a second endmost position of the cutter block adjacent the second end of the slot;

and a slip connector connecting the cutter block to the elongate flexible drive member, the slip connector being arranged such that movement of the elongate flexible drive member along its length causes movement of the cutter block along the slot, the slip connector also being arranged to allow slippage between the elongate flexible drive member and the cutter block such that the elongate flexible drive member continues to move along its length when the cutter block is halted at said first and second endmost positions.

2. The apparatus according to claim 1 including cutter block guide means arranged adjacent the inner face of the support plate and parallel to the slot and having a first end arranged adjacent the first end of the support plate and a second end arranged adjacent the second end of the support plate, and wherein the cutter block is arranged on the cutter block guide means adjacent the inner surface of the support plate for movement therealong.

3. The apparatus according to claim 2 wherein the cutter block guide means comprise a pair of spaced apart flanges aligned with and lying opposite one another, and wherein the cutter block includes a pair of opposed grooves extending therealong for slidably receiving a respective one of the pair of flanges therein.

4. The apparatus according to claim 1 wherein there is provided a cutter blade sharpening grinder mounted at one end of the slot for engaging the cutting blade for sharpening thereof while the cutter block is halted adjacent said end of the slot.

5. The apparatus according to claim 4 wherein the elongate flexible drive member is arranged to drive the cutting blade while the cutter block is halted such that the cutting blade is rotated against the grinder.

6. The apparatus according to claim 4 wherein the sharpening grinder comprises a rotatable disk and wherein the elongate flexible drive member is arranged to drive rotation of the sharpening grinder against the cutting blade while the cutter block is halted.

7. The apparatus according to claim 1 wherein the cutter block carries a rotary guide member over which the elongate flexible drive member passes and wherein the rotary guide member includes a clutch defining said slip connector which slips when torque applied to the rotary guide member exceeds a predetermined value so as to allow said slippage between the elongate flexible drive member and the cutter block when the cutter block is halted.

8. The apparatus according to claim 7 wherein the first and second rotatable guide members are arranged such that the elongate flexible drive member applies a pulling force in a direction transverse to the length of the elongate flexible drive member on the rotary guide member when the cutter block reaches an end of the slot thus tending to release the clutch to allow said slippage.

9. Apparatus for cutting a length of sheet material from a supply of the sheet material comprising:

a support member for receiving the sheet material from the supply having a first side, a second side, a support surface for contacting the sheet material, and an inner face opposite the support surface;

the support member defining a slot having a first end adjacent the first side of the support member and a second end adjacent the second side of the support member and extending therebetween;

a cutter block mounted adjacent the inner face for movement along the slot between the first and second ends of the slot;

a rotary cutter mounted on the cutter block for rotation about an axis generally parallel to the support wall and generally at right angles to the length of the slot, the rotary cutter having a disk shaped blade with an edge of the disk shaped blade projecting through the slot for cutting the sheet material and a drive shaft mounted on the cutter block for rotation relative thereto about the axis for supporting and driving the disk shaped blade about the axis;

a drive member for driving the cutter block back and forth in a direction along the length of the slot;

a cutter blade sharpening grinder mounted at one end of the slot for engaging the cutting blade for sharpening thereof while the cutter block is halted at said one end;

the cutter block, the cutting blade and the sharpening grinder being arranged such that the cutting blade is moved into engagement with the sharpening grinder by said movement of the cutter block to said one end;

the drive shaft being driven by a drive member while the cutter block is halted at said end to drive the cutting blade such that the cutting blade is rotated against the sharpening grinder.

10. The apparatus according to claim 9 wherein the sharpening grinder comprises a rotatable disk which is rotatingly driven against the cutting blade while the cutter block is halted, and wherein the sharpening grinder is driven by the drive member of the cutting blade.

11. Apparatus for cutting a length of sheet material from a supply of the sheet material comprising:

a support member for receiving the sheet material from the supply having a first side, a second side, a support surface for contacting the sheet material, and an inner face opposite the support surface;

the support member defining a slot having a first end adjacent the first side of the support member and a second end adjacent the second side of the support member and extending therebetween;

a cutter block mounted adjacent the inner face for movement along the slot between the first and second ends of the slot;

a rotary cutter mounted on the cutter block for rotation about an axis generally parallel to the support wall and generally at right angles to the length of the slot, the rotary cutter having a disk shaped blade with an edge of the disk shaped blade projecting through the slot for cutting the sheet material and a drive shaft mounted on the cutter block for rotation relative thereto about the axis for supporting and driving the disk shaped blade about the axis;

an elongate flexible drive member extending in a direction along the length of the slot;

a first rotatable guide member arranged adjacent the first end of the slot, a second rotatable guide member arranged adjacent the second end of the slot, each of the rotatable guide members having the elongate flexible drive member wrapped therearound so that the guide members as they rotate guide movement of the elongate flexible drive member along its length;

the cutter block being connected to the elongate flexible drive member such that movement of the elongate flexible drive member along its length causes movement of the cutter block along the slot;

a rotary drive actuator for driving the elongate flexible drive member along its length in a first direction, thereby causing said movement of the cutter block in a first direction along the slot towards the first end of the slot, and along its length in a second direction thereby causing said movement of the cutter block in a second direction along the slot towards the second end of the slot;

a drive sprocket mounted on the shaft for driving the shaft, the drive sprocket being arranged to roll along an elongate member extending alone the length of the slot and having a plurality of abutment shoulders thereon at spaced positions therealong so that teeth of the sprocket are positively driven by the elongate member and so that the cutting blade receives motive force from said movement of the cutter block.

12. The apparatus in accordance with claim 11 wherein the elongate member comprises a portion of a chain.

13. Apparatus for cutting a length of sheet material from a supply of the sheet material comprising:

a support member for receiving the sheet material from the supply having a first side, a second side, a support surface for contacting the sheet material, and an inner face opposite the support surface;

the support member defining a slot having a first end adjacent the first side of the support member and a second end adjacent the second side of the support member and extending therebetween;

a cutter block mounted adjacent the inner face for movement along the slot between the first and second ends of the slot;

a rotary cutter mounted on the cutter block for rotation about an axis generally parallel to the support surface and generally at right angles to the length of the slot, the rotary cutter having a disk shaped blade with an edge of the disk shaped blade projecting through the slot for cutting the sheet material and a drive shaft mounted on the cutter block for rotation relative thereto about the axis for supporting and driving the disk shaped blade about the axis;

an elongate flexible drive member extending in a direction along the length of the slot;

a first rotatable guide member arranged adjacent the first end of the slot, a second rotatable guide member arranged adjacent the second end of the slot, each of the rotatable guide members having the elongate flexible drive member wrapped there around so that the guide members, as they rotate, guide movement of a first run of the elongate flexible drive member along its length and guide movement of a second run of the elongate flexible drive member along its length, with the first and second runs being generally parallel and a direction of movement of the first run being opposite to that of the second run;

a connector connecting the first run to the cutter block for driving movement of the cutter block;

a rotary drive actuator for driving the elongate flexible drive member along its length in a first direction, such that the first run causes said movement of the cutter block in a first direction along the slot to a first endmost position of the cutter block adjacent the first end of the slot, and for driving the elongate flexible drive member along its length in a second direction such that the first run causes said movement of the cutter block in a second direction along the slot to a second endmost position of the cutter block adjacent the second end of the slot;

a drive coupling mounted on the drive shaft of the rotary cutter arranged for engaging the second run of the elongate flexible drive member such that movement of the second run of the elongate flexible drive member effects driving of the blade of the rotary cutter.

14. The apparatus according to claim 13 wherein the drive coupling is arranged such that the blade of the rotary cutter is rotated in a direction of rotation relative to the direction of movement of the cutter block to cause a front part of the blade to move outwardly of the slot toward the support surface and a trailing part of the blade moves inwardly of the slot toward the inner surface.

15. The apparatus according to claim 13 wherein the drive coupling comprises a sprocket and wherein the elongate member has a plurality of abutment shoulders thereon at spaced positions therealong so that teeth of the sprocket are positively driven by the elongate member.

16. The apparatus in accordance with claim 15 wherein the elongate member comprises a chain.

* * * * *